United States Patent [19]

Teruaki

[11] Patent Number: 4,570,140

[45] Date of Patent: Feb. 11, 1986

[54] MAGNET ASSEMBLY FOR ADJUSTING THE RUNNING PATH OF THE ELECTRON BEAM OF COLOR PICTURE TUBE

[75] Inventor: Ueno Teruaki, Mobara, Japan

[73] Assignee: Hitachi, Ltd., Tokyo, Japan

[21] Appl. No.: 111,890

[22] Filed: Jan. 14, 1980

Related U.S. Application Data

[63] Continuation of Ser. No. 664,151, Mar. 5, 1976, abandoned.

[51] Int. Cl.[4] ..... H01F 1/00

[52] U.S. Cl. ..... 335/212; 313/431

[58] Field of Search ..... 313/412, 413, 421, 425, 313/431; 335/212

[56] References Cited

U.S. PATENT DOCUMENTS

| | | | |
|---|---|---|---|
| 2,553,792 | 5/1951 | Smith et al. | 335/212 |
| 2,569,327 | 9/1951 | Obert | 335/212 |
| 2,586,948 | 2/1952 | Heppner | 335/212 |
| 3,247,411 | 4/1966 | Kratz | 313/431 |
| 3,808,570 | 4/1974 | Thompson et al. | 335/212 |
| 3,942,146 | 3/1976 | La Belle | 335/212 |

*Primary Examiner*—Harold Broome

*Attorney, Agent, or Firm*—Charles E. Pfund

[57] ABSTRACT

In a magnet assembly including a pair of annular shaped magnets mounted on the neck of an in-line electron gun type color picture tube for adjusting the running path of the electron beam, the flux density of one magnet on the inlet side of the electron beam is made to be larger than that of the other magnet on the exit side of the electron beam.

5 Claims, 6 Drawing Figures

MAGNET ASSEMBLY FOR ADJUSTING THE RUNNING PATH OF THE ELECTRON BEAM OF COLOR PICTURE TUBE

This is a continuation of application Ser. No. 664,151 filed Mar. 5, 1976 now abandoned.

BACKGROUND OF THE INVENTION

This invention relates to a magnet assembly for adjusting the running paths of the electron beams of a colour picture tube, and more particularly to a magnet assembly for adjusting the running paths of the electron beams including at least one pair of annular shaped magnets surrounding the neck portion of an in-line electron gun type colour picture tube.

Generally, in a colour picture tube provided with in-line electron guns, the axes of three electron guns are arranged on the same plane including the tube axis such that the paths of two outside electron beams emanated from the electron guns located on both sides of the central electron gun will be symmetrical with respect to the path of the electron beam emanated from the central gun. It is advantageous to construct the electron gun assembly of such colour picture tube to cause the electron beams emanating from respective guns but not deflected by deflecting means to converge at the center of a fluorescent screen located in front of the electron gun assembly so as to produce clean pictures.

Actually, however, it is difficult to cause picture tubes to satisfy such ideal condition due to the manufacturing errors of the component parts of the tube or permissible allowance in the dimensions of the component parts. For this reason, the colour picture tubes generally have slightly different characteristics. Accordingly, it is necessary to provide suitable means to correct such error. As is well known in the art adjustable magnetic field has been used to provide the required colour purity adjustment as well as the static convergence adjustment.

For example, the colour purity has been adjusted by mounting a two pole magnet assembly including two superposed two pole annular shaped permanent magnets on the outside of the neck of the colour picture tube so as to surround the running paths of three electron beams and by relatively rotating the two annular shaped permanent magnets.

On the other hand, the static convergence adjustment has been accomplished by providing a pole piece structure for directing the magnetic field on the inside and outside of the neck of the tube and an adjusting magnet combined with the pole piece structure.

It has also been proposed to perform the static convergence adjustment by mounting a four pole magnet assembly including two superposed four pole annular shaped permanent magnets and a six pole magnet assembly including two 6 pole annular shaped permanent magnets on the outside of the neck of the tube to surround the paths of three electron beams. These arrangements are described, for example, in the specifications of U.S. patent application No. 217757 filed on Jan. 14, 1972 by Radio Corporation of America, Japanese patent application No. 58117 of 1972 and Japanese laid open specification No. 82731 of 1973. By adjusting the intensity of the magnetic fields produced by respective magnets of the assembly, the electron beams from respective electron guns are converged at the center of the fluorescent screen under the condition of no deflection.

In terms of the amount of shift of the electron beam on the fluorescent screen, it is necessary to adjust the intensity of the magnetic field of the magnet assembly in a range of from the maximum amount of the shift of the electron beam in which the beam is deviated to the maximum extent from the ideal condition described above and to the minimum amount of the shift of the electron beams. More particularly, where the colour picture type is ideally manufactured so that the electron beams converge at the center of the fluorescent screen with high colour purity, it is not necessary to provide the magnet assembly. Accordingly, the magnet assembly should be manufactured such that even when the magnet assembly is mounted upon the tube, the magnet assembly will never affect the electron beams. In this case, it is not necessary to vary the intensity of the magnetic field produced by the magnet assembly.

In order to vary the intensity of the magnetic field of the magnet assembly, it is usual to constitute the magnet assembly by superposing two annular shaped permanent magnets having the same polarity and the same flux density. Where the polarities of the two permanent magnets are aligned the intensity of the field of the magnet assembly becomes maximum. On the other hand, where the two permanent magnets are rotated relatively over a predetermined angles, for example 180°, 90° or 60°, the intensity of the field of the magnet assembly becomes munimum.

With this construction, however, a magnet assembly capable of shifting the electron beams to the maximum extent is easily obtained by increasing the flux density of the magnets whereas it is difficult to manufacture a magnet assembly whose amount of shifting the electron beam is minimum or substantially zero. Accordingly, where such magnet assembly is mounted on a substantially ideal colour picture tube, the minimum amount of shift of the electron beam is too large thus making it impossible to obtain excellent convergence adjustment.

SUMMARY OF THE INVENTION

Accordingly, it is an object of this invention to provide an improved magnet assembly for adjusting the electron beams of a colour picture tube capable of reducing the minimum amount of the shift of the electron beams to substantially zero.

Another object of this invention is to provide an improved magnet assembly capable of correctly adjusting the purity and the static convergence of a colour picture tube thereby reproducing pictures of high qualities.

According to this invention there is provided a magnet assembly for adjusting the running path of the electron beam of a colour picture tube of the class wherein the magnet assembly comprises a pair of opposed annular shaped magnets mounted on the periphery of the neck of the colour picture tube, characterized in that the flux density of the magnet on the inlet side of the electron beam is made larger than that of the magnet on the exit side of the electron beam.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
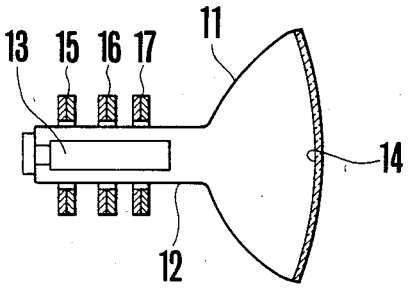
FIG. 1 is a diagrammatic longitudinal sectional view showing the basic construction of an in-line electron gun type colour picture tube provided with the magnet assemblies embodying the invention.

FIG. 1 shows an in-line type colour picture tube incorporated with the novel magnet assemblies of this invention for adjusting the electron beams. The colour picture tube 11 shown in FIG. 1 comprises a neck 12, an in-line type electron gun assembly 13, and a fluorescent screen 14 coated on the inner surface of the face plate of the tube. About the neck 12 are disposed a purity magnet assembly 15, & 6 pole magnet assembly 16 and a four pole magnet assembly 17 which are used to adjust the static convergence.

Figure 2:
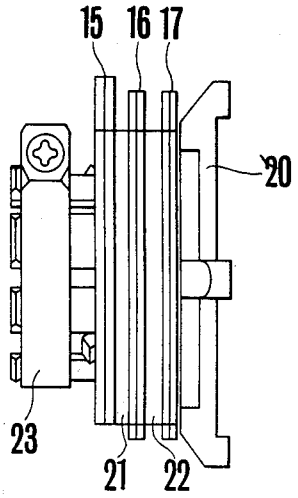
FIG. 2 is a side view showing an electron beam adjusting device comprising three types of the magnet assemblies of this invention for adjusting the electron beams.
Figure 3:
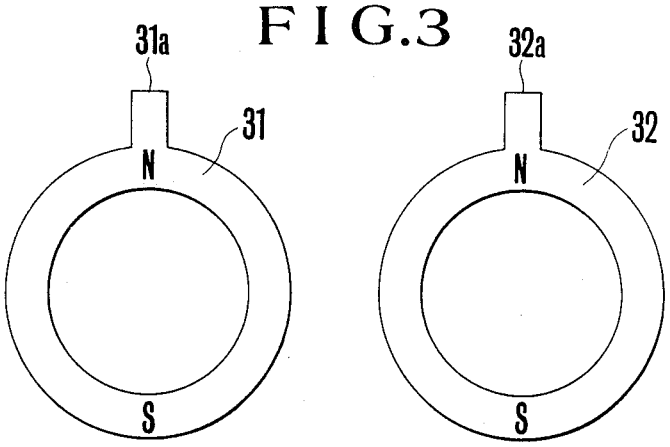
FIG. 3 is a plan view showing the magnetized states of respective permanent magnets which constitute a purity magnet assembly shown in FIG. 2.
Figure 4:
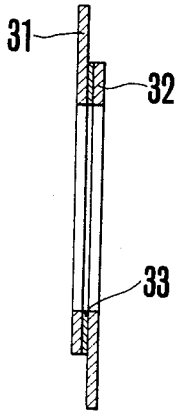
FIG. 4 shows a cross-sectional view of the purity magnet assembly shown in FIG. 2.
Figure 5:
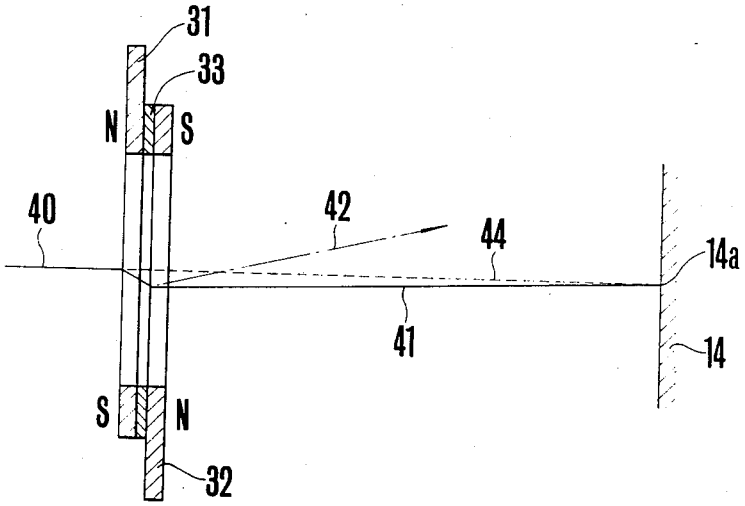
FIG. 5 is a diagram utilized to explain the manner of adjusting the path of an electron beam by utilizing the purity magnet assembly shown in FIGS. 3 and 4.

As shown in FIG. 2, these magnet assemblies 15, 16 and 17 are mounted on a magnet holder 20 made of non-magnetic materials, for example a plastic, and provided with an opening (not shown) for receiving the neck. The magnetic assemblies are spaced each other by non-magnetic spacers 21 and 22, and the magnet holder is clamped to the neck by a stainless steel clamping fixture 23. The purity magnet assembly 15 is constructed as follows. Thus, as shown in FIGS. 3 and 4, this magnet assembly comprises two annular shaped plate magnets 31 and 32 made of barium ferrite, for example, and a thin non-magnetic spacer 33 interposed therebetween. The magnets 31 and 32 are provided with tabs 31*a* and 32*a* and are magnetized to have N and S poles, as shown. In the illustrated example, the portions of the magnets near the tabs are poled N. These magnets are magnetized such that when they are mounted on the neck 12 of the tube the flux density of the magnet 31 on the inlet side of the electron beams will be higher than that of the magnet 32 on the exit side. Such magnet assembly is adjusted for positioning the electron beams at the center of the tube in the following manner. When the magnets are rotated with respect to each other by gripping the tabs so as to cause the poles of the same polarity face with each other as shown in FIG. 3 the electron beams passing through the central openings of the magnets are shifted to the maximum extent from upper toward lower of the drawing. When either one of the magnets is rotated 180° from this position for causing poles of the opposite polarity to face each other, the intensity of the magnetic field of the magnet assembly acting upon the electron beams is minimized. Such function is the same as that of the known adjusting magnet. However, the magnet assembly of the invention operates as follows. That is the invention is characterized by the adjustment of the electron beams passing through the minimum field of the purity magnet assembly 15. With reference to FIG. 5, it is assumed now that the magnetic flux near the center of the magnet 31 flows from upper toward lower of the drawing and that the flux near the center of magnet 32 flows from lower toward upper of the drawing. Electron beam 40 coming from the left is firstly deflected toward lower by the field produced by magnet 31 into the field of magnet 32. The deflection of the electron beam caused by the field of magnet 32 is smaller than that caused by the field of magnet 31 because the intensity of the former field is lower than the latter field so that the electron beam passing through the magnet assembly reaches the center 14*a* of the fluorescent screen 14 through a path 41. In other words, the magnet 31 is located more remotely from the fluorescent screen 14 than the magnet 32, and the spacing between the magnet 32 and the fluorescent screen is much larger than the spacing between the two magnets. For this reason, the electron beam 40 which has been greatly deflected downwardly by the field of the magnet 31 will be deflected a little by the field of magnet 32. If the intensity of the field of the magnet 32 were the same as that of the field of the magnet 31 as in the prior art magnet assembly the electron beam would be deflected greatly as shown by a dot and dash line. Thus, when the novel magnet assembly is combined with an ideal colour picture tube wherein the electron beams from the electron gun assembly travel along a dotted line path 44 shown in FIG. 5 and can reach the center of the fluorescent screen 14 without using any magnet assembly so that it is possible to reduce to substantially zero the amount of the shifting of the electron beams on the fluorescent screen, thus providing an excelling purity adjustment.

It is advantageous to make the flux density of the magnet 31 to be larger than that of the magnet 32 by 10 to 30%. If this difference is lower than 10%, errors in the magnetization of respective magnets reduces the novel effect of this invention, whereas when this difference exceeds 30%, even with an ideal colour picture tube described above, the deflection caused by magnet 31 would be too large thus hindering efficient purity adjustment.

Figure 6:
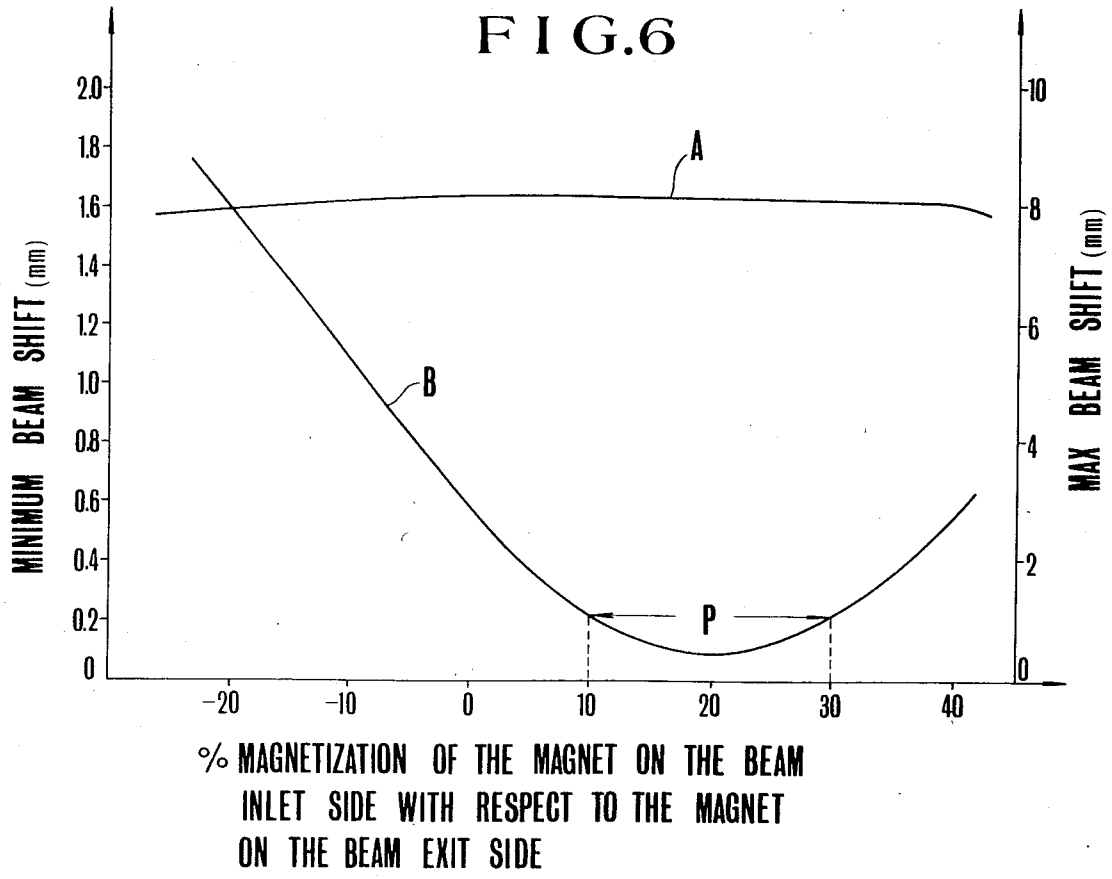
FIG. 6 is a graph showing the relationship between the minimum and maximum amounts of shift of the electron beam, and the intensity of the beam inlet side magnet with respect to the beam exit side magnet.

FIG. 6 is a graph showing the relationship between the maximum and minimum beam shifts and the intensity of magnetization of the purity magnets in which the abscissa represents the percent magnetization of the magnet on the beam inlet side with respect to the magnet on the beam exit side, and the ordinate the maximum and minimum beam shifts. Curve A shows the maximum beam shift whereas curve B the minimum beam shift. The range P is a range of % magnetization by the present invention.

It should be understood that the invention is applicable not only to the purity magnet assembly but also to the static convergence magnet assembly for adjusting the path of the electron beam (six pole magnet assembly 16 and four pole magnet assembly 17), and that the relative position of the assemblies 15, 16 and 17 is not limited to that shown in FIG. 1. Thus, the invention is applicable to any one or all of the magnet assemblies mounted on the neck of the colour picture tube. To what magnet assembly should the invention be applied is determined by the manufacturing error of the colour picture tube such as improper beam centering and improper convergence.

The table below compares the amount of electron beam shift on the fluorescent screen of the tube utilizing the magnet assemblies of this invention and of the tube utilizing the prior art magnet assemblies. As the table shows, each of the purity magnet assembly, the six pole magnet assembly and the four pole magnet assembly which are manufactured in accordance with this invention can greatly reduce the amount of electron beam shift than the prior art magnet assemblies whereby it is possible to adjust accurately the purity and static convergence of the colour picture tube thus producing clear and high quality pictures.

TABLE

| | | Comparison of the Electron Beam Shift on the Fluorescent Screen | | | | | |
|---|---|---|---|---|---|---|---|
| | | Purity magnet assembly (for center electron beam) | | 6 pole magnet assembly (for electron beams on both sides) | | 4 pole magnet assembly (for electron beams on both sides) | |
| | Sample No. | Maximum shift | Minimum shift | Maximum shift | Minimum shift | Maximum shift | Minimum shift |
| Prior art magnet assembly | 1 | 7.5 mm | 0.7 mm | 5.5 mm | 0.6 mm | 8.0 mm | 0.5 mm |
| | 2 | 7.5 | 0.8 | 5.0 | 0.7 | 8.1 | 0.6 |
| | 3 | 7.5 | 0.6 | 6.0 | 0.6 | 8.3 | 0.8 |
| | 4 | 7.5 | 0.7 | 5.5 | 0.8 | 8.3 | 0.8 |
| | 5 | 8.0 | 0.6 | 5.5 | 0.6 | 8.5 | 1.0 |
| | mean | 7.6 | 0.7 | 5.5 | 0.7 | 8.2 | 0.7 |
| | max. | 8.0 | 0.8 | 6.0 | 0.8 | 8.0 | 0.5 |
| | min. | 7.5 | 0.6 | 5.0 | 0.6 | 8.5 | 1.0 |
| Novel magnet assembly | 1 | 8.0 | 0.1 | 5.5 | 0.1 | 7.0 | 0.1 |
| | 2 | 7.6 | 0.1 | 5.2 | 0.1 | 7.5 | 0.2 |
| | 3 | 8.0 | 0.2 | 5.2 | 0.2 | 7.0 | 0.1 |
| | 4 | 8.0 | 0.1 | 5.5 | 0.1 | 7.0 | 0.1 |
| | 5 | 8.0 | 0.1 | 5.0 | 0.1 | 7.0 | 0.3 |
| | mean | 7.9 | 0.1 | 5.3 | 0.1 | 7.1 | 0.2 |
| | max. | 8.0 | 0.2 | 5.5 | 0.2 | 7.5 | 0.3 |
| | min. | 7.5 | 0.1 | 5.2 | 0.1 | 7.0 | 0.1 |

It should be understood that the invention is not limited to the illustrated embodiment and that many changes and modifications will be made within scope of the invention as defined in the appended claims. For example, the spacer between two magnets may be omitted and the magnets may be made of materials other than barium ferrite.

What is claimed is:

1. In a magnet assembly for adjusting the running path of the electron beam of a colour picture tube of in-line electron gun type having an axis of the class wherein the magnet assembly comprises a pair of axially spaced and axially magnetically substantially opposed annular shaped magnets mounted on the periphery of the neck of said colour picture tube and rotatable to adjust the beam shift caused by said magnets, the improvement wherein the magnet assembly comprises a purity magnet assembly of a two pole magnet assembly and a plurality of static convergence magnet assemblies of a four or more pole magnet assembly, wherein the flux density of at least one of the purity and static convergence magnet assemblies is such that the flux density of the magnet on the inlet side of the electron beam is made larger than that of the magnet on the exit side of the electron beam, wherein the flux density of the magnet on the inlet side of the electron beam is from 10 to 30 percent larger than that of the magnet on the exit side of the beam to achieve an adjustable ratio of beam shift substantially greater than an order of magnitude and an adjusted minimal beam shift of approximately 0.2 mm plus or minus 0.1 mm.

2. In a magnet assembly for use on a CRT tube containing an electron gun assembly in the neck of said tube for in-line emission of three electron beams, said assembly including one purity magnet set mounted on the neck of said tube;

two static convergence magnet sets mounted on the neck of said tube adjoining the purity magnet set;

said purity magnet set comprising a pair of axially opposed rings each having two poles;

one of said static convergence magnet sets comprising a pair of axially opposed rings each having four poles, the other set being of a pair of axially opposed rings of six poles;

said sets of magnet rings being rotatable to adjust the flux density acting on the three electron beams passing therethrough within said neck, and when adjacent ring pairs are rotated to be additive providing maximum shift of said beams;

the improvement comprising selecting the flux density to be different between the one pair of opposed rings of at least said purity magnet set and static convergence magnet sets such that the flux density of the ring on the inlet side of the electron beam is 10 to 30 percent larger than that of the ring on the exit side of the beam thereby to provide an adjustable range of shift of said beams from a maximum to a minimal shift from the preset electron beam axis corresponding to ideal color purity and static convergence which is substantially zero.

3. The combination according to claim 2 wherein the ratio of said maximum shift to said minimal shift approaches two orders of magnitude.

4. The combination of claim 3 in which said minimal shift has an absolute value no greater than 0.3 mm.

5. The combination of claim 2 in which said minimal shift has an absolute value no greater than 0.3 mm.

* * * * *